US007330686B2

(12) United States Patent
Nakano et al.

(10) Patent No.: US 7,330,686 B2
(45) Date of Patent: Feb. 12, 2008

(54) COLOR IMAGE FORMING APPARATUS INCLUDING A VOLTAGE ATTENUATING INTERMEDIATE TRANSFER BELT

(75) Inventors: Kuniaki Nakano, Kyoto (JP); Yoshie Iwakura, Higashiosaka (JP); Susumu Murakami, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 135 days.

(21) Appl. No.: 11/235,779

(22) Filed: Sep. 27, 2005

(65) Prior Publication Data

US 2006/0083557 A1 Apr. 20, 2006

(30) Foreign Application Priority Data

Oct. 14, 2004 (JP) ..... 2004-300339

(51) Int. Cl.
*G03G 15/01* (2006.01)

(52) U.S. Cl. ..... 399/302

(58) Field of Classification Search ..... 399/299, 399/302, 308

See application file for complete search history.

(56) References Cited

U.S. PATENT DOCUMENTS 6,160,978 A * 12/2000 Tsuruoka et al. ..... 399/302 X
6,223,015 B1 * 4/2001 Takahata et al. ..... 399/302
6,314,264 B1 * 11/2001 Iida et al. ..... 399/302
7,043,183 B2 * 5/2006 Yoda et al. ..... 399/302
2004/0136760 A1 * 7/2004 Yoshida et al. ..... 399/302
2004/0208678 A1 * 10/2004 Yoda et al. ..... 399/302
2005/0058473 A1 * 3/2005 Mizuno et al. ..... 399/302

FOREIGN PATENT DOCUMENTS

JP 09-034269 2/1997
JP 11-167294 6/1999

* cited by examiner

*Primary Examiner*—Sandra L. Brase
(74) *Attorney, Agent, or Firm*—Renner, Otto, Boisselle & Sklar, LLP

(57) ABSTRACT

A color image forming apparatus includes: a multiple number of process printing units, each having an photoreceptor drum for supporting a developer image formed with a developer corresponding to each color of color-separated image information; a transfer belt to which the developer images formed on the photoreceptor drums are transferred; and a transfer roller for transferring the transferred developer image to recording paper, and is constructed so that the transfer belt is formed of a material which makes it possible for the transfer belt to attenuate the voltage charged thereon by 1,000 V or greater while it moves from a position where secondary transfer is performed to a position where the initial primary transfer is performed.

14 Claims, 3 Drawing Sheets

COLOR IMAGE FORMING APPARATUS INCLUDING A VOLTAGE ATTENUATING INTERMEDIATE TRANSFER BELT

This Nonprovisional application claims priority under 35 U.S.C. § 119(a) on Patent Application No. 2004-300339 filed in Japan on 14 Oct. 2004, the entire contents of which are hereby incorporated by reference.

BACKGROUND OF THE INVENTION (1) Field of the Invention

The present invention relates to a color image forming apparatus and in particular relates to a color image forming apparatus, such as a copier, printer, facsimile machine or the like, which uses electrophotography as a process of image forming, wherein an intermediate transfer medium of an endless belt is used for transferring developer images formed on image bearing members.

(2) Description of the Prior Art

Recently, in the field of image forming apparatus, there is a common trend toward color configurations, and with the development of color image forming apparatus, an increased number of color image forming apparatus have become used.

As one of the color image forming systems, a configuration using an endless intermediate transfer belt has been known in which developer images (color images of information formed with multiple colors of developers) formed on photoreceptor drums by image forming means are transferred to the intermediate transfer belt (primary transfer) and the lamination of the developer images transferred on the intermediate transfer belt is further transferred to the paper (secondary transfer).

Usually, in a color image forming apparatus using the intermediate transfer scheme including primary and secondary transfer stages, the applied electric fields generally are specified so as to satisfy the following relationship: [(primary transfer electric field)×0.5]<(secondary transfer electric field)<[(primary transfer electric field) ×1.7].

In order to preferably transfer the developed image primarily transferred on the intermediate transfer belt to the paper at the time of secondary transfer, it is necessary to negate the effect of the electric field at secondary transfer until the intermediate transfer belt reaches the first point at which the primary transfer is performed next (the primary transfer station, downward of and closest to the secondary transfer station with respect to the moving direction of the intermediate transfer belt).

For this purpose, there have been known color image forming apparatus using an intermediate transfer belt, in which an intermediate transfer belt erasing device (applying an erasing electric field or grounding the belt) is disposed between the secondary transfer and the primary transfer with respect to the moving direction (direction of travel) of the intermediate transfer belt, by taking the belt characteristics (attenuation characteristics as to the applied voltage) into account (see Japanese Patent Application Laid-open Hei 11 No. 167294).

The erasing device stated above, however, not only promotes enlargement of the apparatus but also unable to achieve perfect removal of the static charge from the intermediate transfer belt. Specifically, the static charge on the top surface of the intermediate transfer belt can be erased by the aforementioned erasing device, but the charge dwelling in the interior of the intermediate transfer belt cannot be erased, and the static charge moves up to the top surface as time passes. Resultantly, the top surface, being at a time erased, will bear static charge once again.

If image forming is implemented continuously with this situation left as is, static electric charge will build up on the intermediate transfer belt, inducing a high voltage and high electric field. As a result, there occurs the problem of transfer failures at the times of primary and secondary transfer.

SUMMARY OF THE INVENTION

The present invention has been devised in view of the above problem, it is therefore an object of the present invention to provide a color image forming apparatus in which the electric field charged on an intermediate transfer belt thereof can be attenuated by a simple configuration.

In order to achieve the above object, the color image forming apparatus according to the present invention can be configured as follows.

In accordance with the first aspect of the present invention, a color image forming apparatus includes: a plurality of image forming units, each having an image bearing member for supporting a developer image formed with a developer corresponding to each color of color-separated image information; a primary transfer means having an intermediate transfer belt to which developer images formed on the image bearing members are transferred; and a secondary transfer means for transferring the developer image transferred on the intermediate transfer belt to a printing medium, and is characterized in that the intermediate transfer belt is formed of a material which makes it possible for the intermediate transfer belt to attenuate the potential charged thereon by 1,000 V or greater while it moves from a position where secondary transfer is performed to a position where the initial primary transfer is performed.

In accordance with the second aspect of the present invention, the color image forming apparatus having the above first feature is further characterized in that the residual potential on the intermediate transfer belt, dropped from the voltage applied at secondary transfer after the intermediate transfer belt has moved from the secondary transfer position to the initial primary transfer position, is lower than the voltage to be applied at primary transfer.

In accordance with the third aspect of the present invention, the color image forming apparatus having the above first or second feature is further characterized in that the intermediate transfer belt has a resistivity falling within the range of $1\times10^{8}$ to $1\times10^{13}$ Ω·cm, where $R=\rho\cdot d/S$ R: resistance value (Ω)

d: belt thickness (cm)

S: belt area ($cm^2$)

ρ: resistivity (Ω·cm).

In accordance with the fourth aspect of the present invention, the color image forming apparatus having the above first, second or third feature is further characterized in that the intermediate transfer belt is mainly formed of polycarbonate (PC), polyimide (PI) or thermoplastic elastomer alloy (TPE).

According to the first to fourth aspects of the invention, in a color image forming apparatus including: a plurality of image forming units, each having an image bearing member for supporting a developer image formed with a developer corresponding to each color of color-separated image information; a primary transfer means having an intermediate transfer belt to which developer images formed on the image bearing members are transferred; and a secondary transfer means for transferring the developer image transferred on the intermediate transfer belt to a printing medium, the intermediate transfer belt is formed of a material which makes it possible for the intermediate transfer belt to attenuate the potential charged thereon by 1,000 V or greater while it moves from a position where secondary transfer is performed to a position where the initial primary transfer is performed. It is therefore possible to attenuate the voltage charged on the intermediate transfer belt with a simple configuration, hence constantly realize desirable secondary transfer.

Further, in addition to the above common effect obtained from the above first to fourth aspects of the invention, each aspect of the invention presents the following effect.

Detailedly, in accordance with the second aspect of the invention, since the residual potential on the intermediate transfer belt, dropped from the voltage applied at secondary transfer after it has moved from the secondary transfer position to the initial primary transfer position, is made lower than the voltage to be applied at primary transfer, it is possible to minimize the voltage built up on the intermediate transfer belt, hence stable secondary transfer can be performed even if continuous printing is implemented.

Generally, the voltage applied to the intermediate transfer belt at primary transfer is specified to be as high as 700 to 1,500 V, and the voltage applied to the intermediate transfer belt at secondary transfer is specified to be as high as 1,500 to 3,000 V.

Accordingly, the potential of the intermediate transfer belt, applied for secondary transfer is attenuated by 1,000 V or greater during the period from the secondary transfer station to the initial primary transfer station, thus the potential on the intermediate transfer belt becomes lower than the applied voltage for primary transfer. Therefore, it is possible to minimize the voltage built up on the intermediate transfer belt.

According to the third aspect of the present invention, since the intermediate transfer belt is specified to have a resistivity falling within the range of $1\times10^{8}$ to $1\times10^{13}\Omega\cdot$cm, where $R=\rho\cdot d/S$ R: resistance value ($\Omega$)

d: belt thickness (cm)

S: belt area ($cm^2$)

$\rho$: resistivity ($\Omega\cdot$cm), it is possible to attenuate the electric field by reduction of the time constant: $\epsilon\rho$ of the intermediate transfer belt. Therefore, it is possible to surely attenuate the voltage changed on the intermediate transfer belt.

According to the fourth aspect of the present invention, formation of the intermediate transfer belt mainly with polycarbonate (PC), polyimide (PI) or thermoplastic elastomer alloy (TPE), makes it possible to efficiently attenuate the voltage charged on the intermediate transfer belt.

As described above, the present invention has been completed by investigating various kinds of materials for the intermediate transfer belt, and as a result of the investigation, selecting based on the "time constant" that represents the characteristics of the intermediate transfer belt, a material which attenuates the charged potential on the intermediate transfer belt, by 1,000 V or greater during the movement of the belt from the secondary transfer station to the initial primary transfer station, makes it possible to achieve desirable secondary transfer.

DESCRIPTION OF THE PREFERRED EMBODIMENTS

The best mode for carrying out the present invention will hereinafter be described with reference to the drawings.

Figure 1:
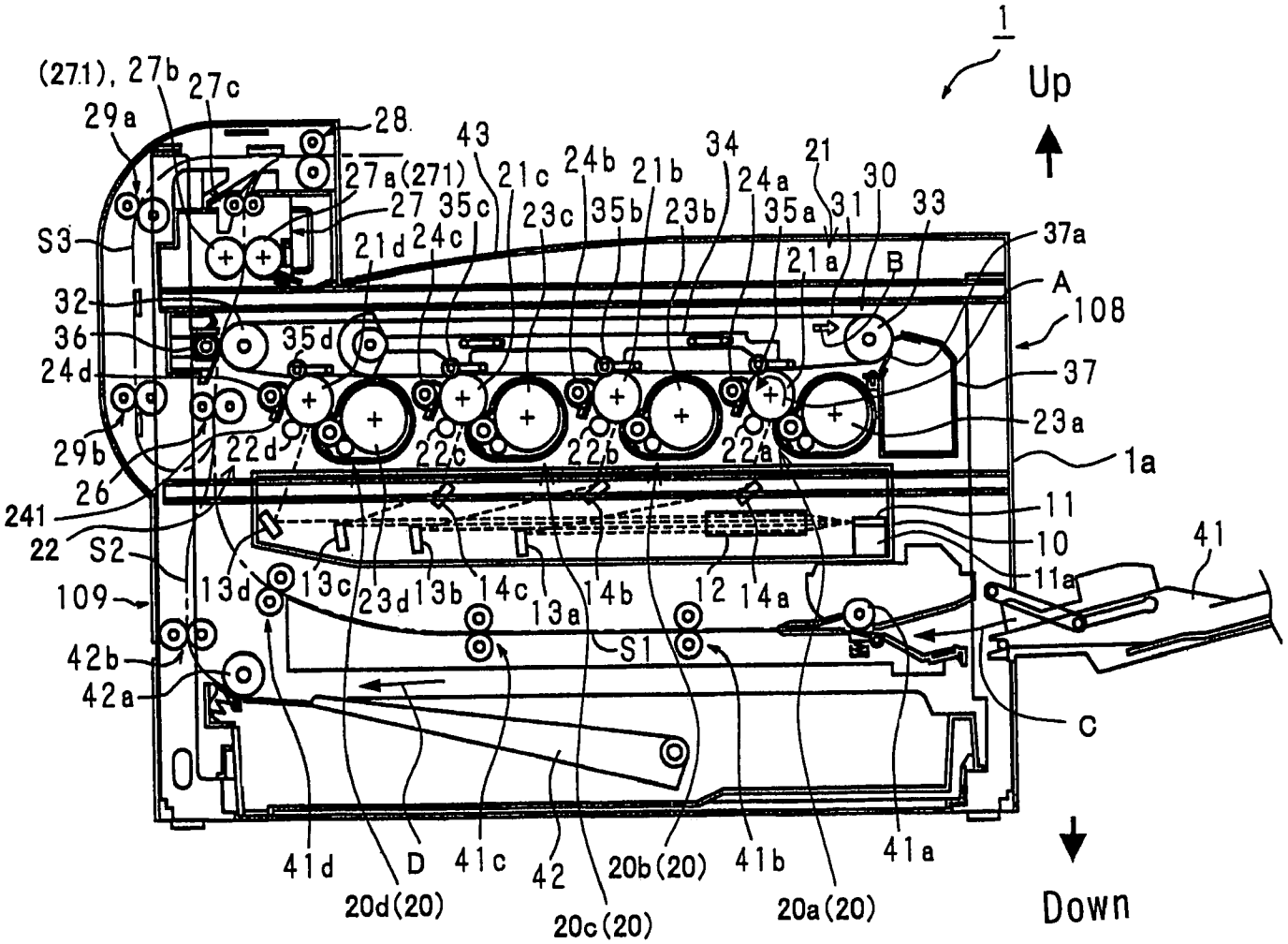
FIG. 1 is an illustrative diagram (sectional view from the rear) showing the overall configuration of a color image forming apparatus according to the embodiment of the present invention.

FIG. 1 shows one example of the present invention and is an illustrative diagram (sectional view from the rear) showing the overall configuration of a color image forming apparatus according to one embodiment of the present invention.

As shown in FIG. 1, a color image forming apparatus 1 of the present embodiment includes: a plurality of image forming units or namely, process printing units 20 (20*a*, 20*b*, 20*c* and 20*d*) each having a photoreceptor drum 21 (21*a*, 21*b*, 21*c* or 21*d*) for supporting a developer image (which will be referred to as "toner image" hereinbelow) formed with a developer (which will be referred to as "toner" hereinbelow) corresponding to the color of color-separated image information; an endless transfer belt 31 or an intermediate transfer belt constituting a primary transfer means, to which a multiple number of toner images are transferred in layers; and a transfer roller 36 constituting a secondary transfer means for transferring the toner images that have been transferred in layers on the transfer belt 31, all at once, to a recording sheet as a print medium, and is constructed such that the plurality of process printing units 20*a*, 20*b*, 20*c* and 20*d* are arranged along the transfer belt 31.

Here, concerning the positional relationship between the color image forming apparatus 1 of the embodiment and the operator, the operator is supposed to stand at the far side of the color image forming apparatus 1 shown in FIG. 1. In other words, the control side is located on the unillustrated side of color image forming apparatus 1, and the left and right sides of FIG. 1, as viewed, are the reverse of those when the operator faces the control side.

In the following description, the front side (F-side) refers to the operator side and the rear side (R-side) refers to the backside of color image forming apparatus 1, or the side shown by FIG. 1.

To begin with, the overall configuration of color image forming apparatus 1 will be described.

As shown in FIG. 1, color image forming apparatus 1 according to the present embodiment is a so-called digital color printer which is adapted to output a color image by separating color image information into images of individual colors, is mainly composed of an image forming portion 108 and a paper feed portion 109, and forms a multi-color image or monochrome image on recording paper in accordance with a print job sent from an information processor (not illustrated) such as a personal computer etc., externally connected.

Image forming portion 108 forms multi-color images based on electrophotography with yellow (Y), magenta (M), cyan (C) and black (K) colors. This image forming portion is mainly composed of an exposure unit 10, process printing units 20, a fixing unit 27, a transfer belt unit 30 as a primary transfer means having a transfer belt 31, a transfer roller 36 and a transfer belt cleaning unit 37.

Describing the overall arrangement of image forming portion 108, fixing unit 27 is disposed on the top at one end side of a housing 1*a* of color image forming apparatus 1, transfer belt unit 30 is extended under the fixing unit 27 from the one end side to the other end side of housing 1*a*, process printing units 20 are disposed under the transfer belt unit 30, and exposure unit 10 is disposed under the process printing units 20. Further, transfer belt cleaning unit 37 is arranged on the other side end of transfer belt unit 30. Also, a paper output tray 43 is arranged contiguous to fixing unit 27, over image forming portion 108.

Paper feed portion 109 is arranged under the image forming portion 108.

In the present embodiment, as process printing units 20, four process printing units 20*a*, 20*b*, 20*c* and 20*d*, corresponding to individual colors, i.e., black (K), yellow (Y), magenta (M) and cyan (C), are arranged in the order mentioned along transfer belt 31.

The process printing unit 20*a* for the color whose toner image, among all the toner images to be transferred to transfer belt 31, is transferred to transfer belt 31 first, or in other words, the process printing unit 20*a* which is located at a position most distant from transfer roller 36, holds a toner of black color so as to form a black toner image first on transfer belt 31.

These process printing units 20*a*, 20*b*, 20*c* and 20*d* are arranged in parallel to each other, in the approximately horizontal direction (in the left-to-right direction in the drawing) in housing 1*a*, and include respective photoreceptor drums 21*a*, 21*b*, 21*c* and 21*d* as the image bearing member for each individual associated color, respective charging devices 22*a*, 22*b*, 22*c* and 22*d* for charging the photoreceptor drums 21*a*, 21*b*, 21*c* and 21*d*, respective developing devices 23*a*, 23*b*, 23*c* and 23*d* and respective cleaner units 24*a*, 24*b*, 24*c* and 24*d* and other components.

Here, the symbol a, b, c, and d are added to the constituents so as to show correspondence to black (K), yellow (Y), magenta (M) and cyan (C), respectively. In the description hereinbelow, however, the constituents provided for each color are generally referred to as photoreceptor drum 21, charging device 22, developing device 23, and cleaner unit 24, except in the case where a constituent corresponding to a specific color needs to be specified.

Photoreceptor drum 21 is arranged so that part of its outer peripheral surface comes into contact with the surface of transfer belt 31 while charging device 22 as an electric field generator, developing device 23 and cleaner unit 24 are arranged along, and close to, the outer peripheral surface of the drum.

As charging device 22, a roller type charger is used and arranged, at a position on the approximately opposite side across photoreceptor drum 21, from transfer belt unit 30, and in contact with the outer peripheral surface of photoreceptor drum 21. Though in the present embodiment a roller type charger is used as charging device 22, a brush type charger, discharging type charger or the like may be used in place of the roller type charger.

Developing device 23 holds a toner of black (K), yellow (Y), magenta (M) or cyan (C) color and is arranged on the downstream side of charging device 22 with respect to the rotational direction of the photoreceptor drum (in the direction of arrow A in the drawing), so that the toner of each color is supplied to the electrostatic latent image formed on the peripheral surface of the photoreceptor drum 21 to produce a visual image.

Cleaner unit 24 is arranged on the upstream side of charging device 22 with respect to the rotational direction of the photoreceptor drum. Cleaner unit 24 has a cleaning blade 241 and is configured so that the cleaning blade 241 is positioned in abutment with the outer peripheral surface of photoreceptor drum 21 so as to scrape and collect leftover toner off the photoreceptor drum 21.

Exposure unit 10 is to create an electrostatic latent image by radiating a laser beam onto the surface of photoreceptor drum 21 of each color in accordance with the image data for printing, and is mainly composed of a laser scanning unit (LSU) 11 having a laser illuminator 11*a*, a polygon mirror 12 and reflection mirrors 13*a*, 13*b*, 13*c*, 13*d*, 14*a*, 14*b* and 14*c* for reflecting the laser beam for different colors.

The laser beam emitted from laser illuminator 11*a* is separated into components for different colors, by polygon mirror 12, so that the separated components of light are reflected by respective reflection mirrors 13*a* to 13*d* and 14*a* to 14*c* to illuminate the corresponding photoreceptor drums 21 of every color.

Here, concerning laser scanning unit 11, a writing head made up of an array of light emitting elements such as EL (electro luminescence), LED (light emitting diode) and others, may also be used instead of laser illuminator 11*a*.

Transfer belt unit 30 is mainly composed of transfer belt 31, a transfer belt drive roller 32, a transfer belt driven roller 33, a transfer belt tension mechanism 34 and intermediate transfer rollers 35*a*, 35*b*, 35*c* and 35*d*.

In the following description, any of the intermediate transfer rollers 35*a*, 35*b*, 35*c* and 35*d* will be referred to as intermediate transfer roller 35 when general mention is made.

Transfer belt 31 is formed of an endless film of about 75 μm to 120 μm thick. Transfer belt 31 is mainly made from polyimide, polycarbonate, thermoplastic elastomer alloy or the like and is constructed so that its resistivity falls within the range of $1\times10^{8}$ to $1\times10^{13}$ Ω·cm.

Specifically, in the present embodiment, the resistance value is specified to be $1\times10^{10}$ (Ω), the transfer belt thickness is to be 100 (μm) and the area of the transfer belt is to be 2,700 ($cm^2$), and the resistivity is set to be $1\times10^{10}$ (Ω·cm).

Also, transfer belt 31 is tensioned by transfer belt drive roller 32, transfer belt driven roller 33, transfer belt tension mechanism 34 and intermediate transfer rollers 35 so that its surface comes into contact with the outer peripheral surfaces of photoreceptor drums 21, and is adapted to move in the auxiliary scan direction (in the direction of arrow B in the drawing) by a driving force of the transfer belt drive roller 32.

Transfer belt drive roller 32 is disposed at one end side of housing 1*a* and drives the transfer belt 31 by applying a driving force to the belt whilst nipping and pressing the transfer belt 31 and a recording sheet together between itself and transfer roller 36 to convey the recording sheet.

Transfer roller 36 constitutes a secondary transfer means for transferring the developer image which has been transferred on transfer belt 31 to recording paper, and is arranged opposing transfer belt drive roller 32 at approximately the same level and in parallel thereto and pressing against the transfer belt 31 wound on the transfer belt drive roller 32, forming a predetermined nip therewith while being applied with a high voltage (e.g., about 1,500 to 3,000 V) of a polarity (+) opposite to the polarity (−) of the static charge on the toner, for transferring the multi-color toner image formed on the transfer belt 31 to recording paper.

In the present embodiment, since process printing units 20 are arranged under the wound transfer belt 31, the voltage of the electric field applied from transfer roller 36 to transfer belt 31 is adapted to attenuate by 1000 V or greater, at least during the travel of the rotating transfer belt 31 along its upper side section from transfer belt drive roller 32 to transfer belt driven roller 33.

In order to produce a constant nip between transfer belt 31 and transfer roller 36, either transfer belt drive roller 32 or transfer roller 36 may be formed of a hard material such as metal or the like while the other roller may be formed of a soft material such as elastic rubber, foamed resin, etc.

A registration roller 26 is provided under transfer belt drive roller 32 and transfer roller 36. This registration roller 26 is configured to set the front end of the recording sheet fed from paper feed portion 109 in register with the leading end of the toner image on transfer belt 31 and deliver the paper toward the transfer roller 36 side.

Transfer belt driven roller 33 is disposed on the other end side of housing 1*a*, so as to suspend and tension the transfer belt 31 approximately horizontally from the one end side to the other end side of housing 1*a*, in cooperation with transfer belt drive roller 32.

Intermediate transfer rollers 35 are arranged in the interior space of transfer belt 31 wound between transfer belt drive roller 32 and transfer belt driven roller 33 so as to abut the inner surface of transfer belt 31 and press its outer peripheral surface against the outer peripheral surfaces of the photoreceptor drums 21.

Further, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft.

Each intermediate transfer roller 35 is applied with a high-voltage transfer bias for transferring the toner image formed on photoreceptor drum 21 to transfer belt 31, i.e., a high voltage (e.g., about 700 V to 1,500 V) of a polarity (+) opposite to the polarity (−) of the electrostatic charge on the toner, so as to apply a uniform high voltage from the elastic material to transfer belt 31.

Transfer belt cleaning unit 37 has a cleaning blade 37*a* arranged near transfer belt driven roller 33 so that the cleaning blade 37*a* can abut transfer belt 31 and scrape and collect leftover toner from transfer belt 31.

Also, transfer belt cleaning unit 37 is located near process printing unit 20*a*, on the upstream side of the process printing unit 20*a* with respect to the moving direction of transfer belt 31.

Fixing unit 27 includes: as shown in FIG. 1, paired fixing rollers 271 consisting of a roller 27*a* and a pressing roller 27*b*; and a conveying roller 27*c* above the fixing rollers 271. A recording sheet is input from below fixing rollers 271 and output to above conveying roller 27*c* .

A paper discharge roller 28 is arranged above fixing unit 27, so that the recording sheet conveyed from conveying roller 27*c* is discharged by the paper discharge roller 28 to paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep the heat roller 27*a* at a predetermined temperature (fixing temperature) while the recording sheet with a toner image transferred thereon is heated and pressed between heat roller 27*a* and pressing roller 27*b* as it is being conveyed and rolled, so that the toner image is thermally fused onto the recording sheet.

A duplex printing paper path S3 for double-sided printing is constructed adjacent to fixing unit 27, from the rear of fixing unit 27 downward to the vicinity of paper feed portion 109. Conveying rollers 29*a* and 29*b* are arranged at the top and bottom and along the duplex printing paper path S3, thereby the recording sheet is delivered again toward transfer roller 36 with its face inverted.

Specifically, conveying roller 29*a* is disposed at the rear of fixing unit 27 and conveying roller 29*b* is located below conveying roller 29*a* with respect to the top and bottom direction and at approximately the same level as registration roller 26.

Next, the configuration of paper feed portion 109 will be described.

Paper feed portion 109 includes a manual feed tray 41 and paper feed cassette 42 for holding recording sheets to be used for image forming, and is adapted to deliver recording sheets, one by one, from manual feed tray 41 or paper feed cassette 42 to image forming portion 108.

As shown in FIG. 1, manual feed tray 41 is arranged at one side end (on the right side in the drawing) of housing 1*a* of color image forming apparatus 1 so that it can be unfolded outside when used and folded up to the one end side when unused. This tray delivers paper, one by one, into the housing 1*a* of color image forming apparatus 1 when the user places a few recording sheets (necessary number of sheets) of a desired type.

Arranged on the downstream side with respect to the paper feed direction (the direction of arrow C in the drawing) of recording paper by manual feed tray 41, inside housing 1*a* of color image forming apparatus 1, is a pickup roller 41*a* below exposure unit 10. Conveying rollers 41*b*, 41*c* and 41*d* are also disposed at approximately the same level along the path downstream with respect to the paper feed direction.

Pickup roller 41*a* touches one edge part of the surface of the recording sheet that is fed from manual feed tray 41 and reliably conveys the paper, sheet by sheet, by the function of roller's frictional resistance.

Conveying roller 41*d* located on the most downstream side is positioned above conveying rollers 41*b* and 41*c*, so as to convey the recording paper upward.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A conveying roller 42*b* is also provided obliquely above and on the downstream side of the pickup roller 42*a* with respect to the recording paper feed direction (the direction of arrow D in the drawing).

Pickup roller 42*a* picks up one edge of the surface of the topmost recording sheet of a stack of recording sheets on paper feed cassette 42 and reliably feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Next, image output by color image forming apparatus 1 in the present embodiment will be described.

Color image forming apparatus 1 is constructed so as to transfer the toner images formed on photoreceptor drums 21 to a recording sheet fed from paper feed portion 109 by a so-called intermediate transfer process, or via transfer belt unit 30.

First, charging device 22 uniformly electrifies the outer peripheral surface of photoreceptor drum 21 at a predetermined voltage.

The electrified photoreceptor drum 21 is irradiated with a laser beam from exposure unit 10, so that a static latent image for each color is formed on the photoreceptor drum 21 for the corresponding color.

Then, toner is supplied from developing device 23 to the outer peripheral surface of photoreceptor drum 21 so that the static latent image formed on the outer peripheral surface of photoreceptor drum 21 is visualized with toner so as to form a toner image.

The toner images formed on photoreceptor drums 21 are transferred to transfer belt 31.

Transfer of the toner image from photoreceptor drum 21 to transfer belt 31 is done by intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge, on photoreceptor drum 21 is transferred to transfer belt 31 as the photoreceptor drum 21 turns and comes into contact with transfer belt 31.

The toner images of colors formed on respective photoreceptor drums 21 are transferred to transfer belt 31 as photoreceptor drums 21 turn and comes into contact with the moving belt, and overlaid one over another, thus a color toner image is formed on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by the function of transfer roller 36 and remains on transfer belt 31, would cause contamination of color toners at the next operation, it is removed and collected by transfer belt cleaning unit 37.

Next, the operation of feeding recording sheets by paper feed portion 109 will be described.

When the recording paper placed on manual feed tray 41 is used, the paper is taken in by pickup roller 41*a* from manual feed tray 41, sheet by sheet, at controlled timings in accordance with the instructions from the control panel (not shown), and fed into the machine.

The recording sheet thus taken into the machine is conveyed along recording paper feed path S1 by conveying rollers 41*b*, 41*c* and 41*d* to image forming portion 108.

When the recording paper accommodated in paper feed cassette 42 is used, the paper is separated and fed from paper feed cassette 42, sheet by sheet, by pickup roller 42*a*, and conveyed by conveying roller 42*b* along recording paper feed path S2 to image forming portion 108.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with a toner image formed thereon is further conveyed approximately vertically and reaches fixing unit 27, where the toner image is thermally fixed to the recording sheet by heat roller 27*a* and pressing roller 27*b*.

The recording sheet having passed through fixing unit 27, is discharged by discharge roller 28 when one-sided printing is selected, and placed face down on paper output tray 43.

In contrast, when double-sided printing is selected, the recording sheet is stopped and nipped by paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed.

Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged to paper output tray 43 by paper discharge roller 28.

Thus, the transfer operation to the recording sheet is done as described heretofore.

Next, the potential or electric field distribution created by the primary transfer stations and the secondary transfer station in the color image forming apparatus of the present embodiment will be described with reference to the drawings.

To begin with, the positional relationship between the primary transfer stations and secondary transfer station in transfer belt 31 of color image forming apparatus 1 will be described.

Figure 2:
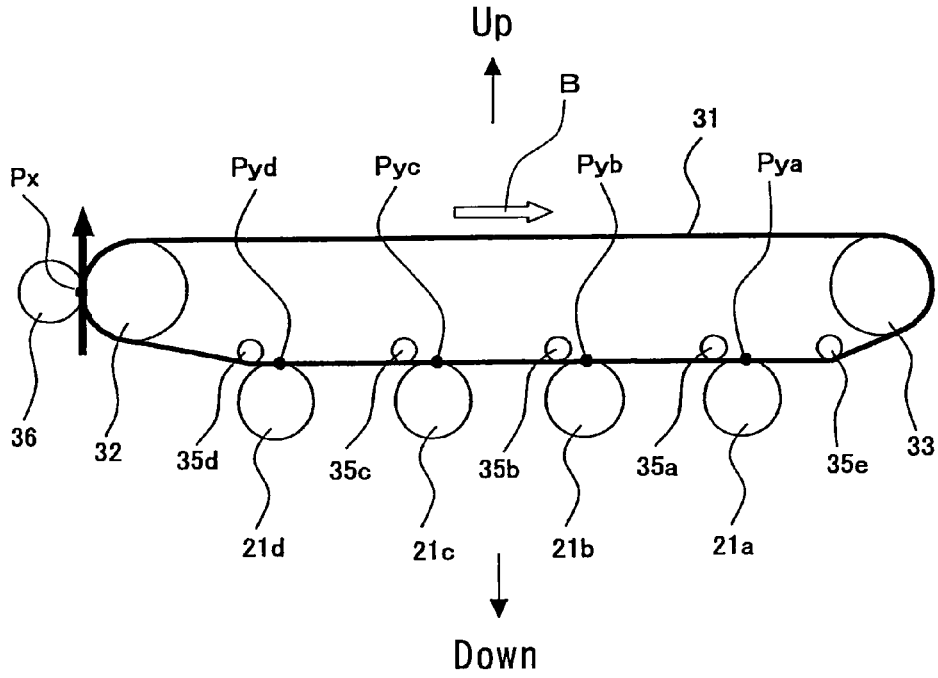
FIG. 2 is an illustrative diagram showing the arrangement of a transfer belt of the embodiment.

FIG. 2 is an illustrative view showing the arrangement of the transfer belt of this embodiment.

In this embodiment, as shown in FIG. 2, transfer belt 31 is wound and tensioned between transfer belt drive roller 32 and transfer belt driven roller 33 while photoreceptor drums 21*a*, 21*b*, 21*c* and 21*d* are arranged from the upstream side, with respect to the moving direction of transfer belt 31, in the order mentioned, under the tensioned transfer belt 31.

Intermediate transfer rollers 35*a*, 35*b*, 35*c* and 35*d* are disposed downstream of respective photoreceptor drums 21*a*, 21*b*, 21*c* and 21*d* with respect to the moving direction of transfer belt 31.

The shaft centers of photoreceptor drums 21*a*, 21*b*, 21*c* and 21*d* are disposed offset, in the left and right direction of transfer belt 31 in the drawing, from those of intermediate transfer roller 35*a*, 35*b*, 35*c* and 35*d*, respectively. With this arrangement, transfer belt 31 is made in contact with a certain area of each of intermediate transfer rollers 35*a*, 35*b*, 35*c* and 35*d* so as to secure a desired nip width.

Further, in order to make the nip width between photoreceptor drum 21*a* and transfer belt 31 equal to those between photoreceptor drums 21*b*, 21*c* and 21*d* and transfer belt 31, a guide roller 35*e* is provided on the upstream side of photoreceptor drum 21*a* with respect to the moving direction of transfer belt 31.

The reference positions at which the electric field is applied to transfer belt 31 by intermediate transfer rollers 35*a*, 35*b*, 35*c* and 35*d* in the primary transfer stations are assumed to be the points Pya, Pyb, Pyc and Pyd where the belt comes in contact with photoreceptor drums 21*a*, 21*b*, 21*c* and 21*d*.

The reference position at which the electric field is applied to transfer belt 31 by transfer roller 36 in the secondary transfer station is assumed to be the point Px where transfer roller 36 and transfer belt drive roller 32 oppose each other.

Next, the potential or electric field distribution created by the primary transfer stations and secondary transfer station on transfer belt 31 of the present embodiment will be described with reference to the drawings.

Figure 3:
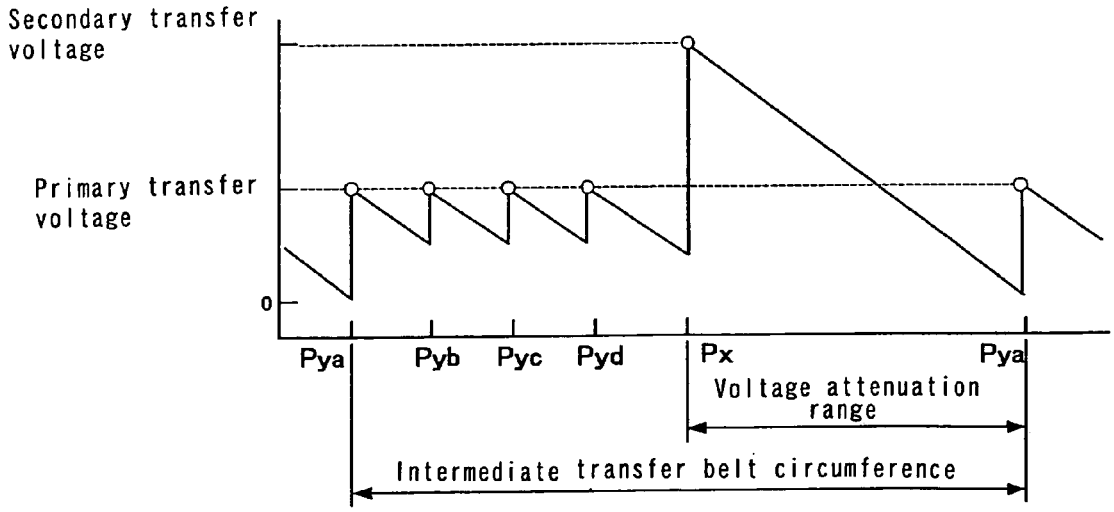
FIG. 3 is an illustrative diagram showing the distribution of the electric field in the transfer belt.
Figure 4:
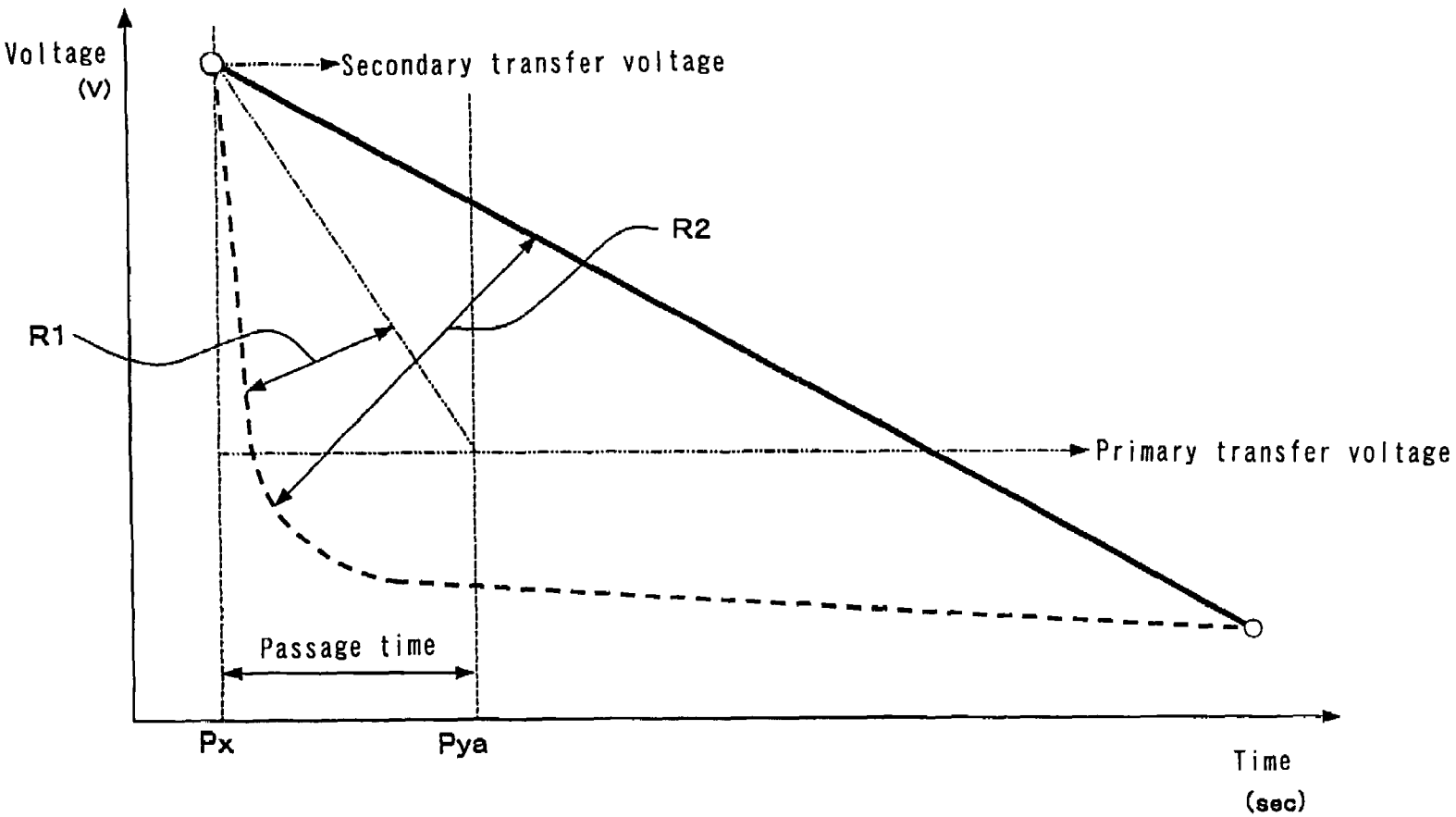
FIG. 4 is an illustrative diagram showing voltage attenuation in the transfer belt with passage of time.

FIG. 3 shows a chart for illustrating the potential or electric field distribution on the transfer belt of the present invention. FIG. 4 is a chart for illustrating the attenuation of the potential of the transfer belt with passage of time.

As shown in FIG. 3, the applied voltage to transfer belt 31 at primary transfer reaches about 1,000 to 1,200 (V) at the reference positions Pya, Pyb, Pyc and Pyd located on photoreceptor drums 21*a*, 21*b*, 21*c* and 21*d*.

The applied voltage to transfer belt 31 at secondary transfer reaches about 1,500 to 2,000 (V) at the reference position Px where transfer roller 36 and transfer belt drive roller 32 oppose each other.

During the period in which transfer belt 31 moves from the reference position Px for secondary transfer to the reference position Pya where the initial primary transfer is performed, the potential charged on transfer belt 31 is attenuated down to a value lower than the primary transfer voltage.

As shown in FIG. 2, the area where transfer belt 31 is charged correspond to equal to or shorter than half the full circumference of transfer belt 31. As shown in FIG. 3, the potential on transfer belt 31 attenuates down to a level lower than the primary transfer voltage, at least within the period in which the transfer belt 31 moves by half the length of the full circumference of transfer belt 31.

Observing the state of attenuation of the charged potential on transfer belt 31 depending on time, the potential charged at the reference position Px of transfer belt 31 at secondary transfer sharply declines after the secondary transfer, and attenuates down to a level much lower than the potential charged at primary transfer within the period in which it reaches the reference position Pya for primary transfer, as shown in FIG. 4.

In FIG. 4, a state where the charged potential on transfer belt 31 attenuates down to the level of the voltage applied at primary transfer during the period from time of secondary transfer to time of the initial primary transfer is shown, and a reference numeral R1 designates the range within which a usable transfer belt 31 falls.

A reference numeral R2 designates the inclination of attenuation which varies depending on the time constant of the transfer belt that is determined based on the material used for the transfer belt and the belt configuration.

As described heretofore, according to the transfer belt 31 of the present embodiment, it is possible to configure the transfer belt so that the potential charged on transfer belt 31 will become lower than the voltage applied at primary transfer even when continuous printing is implemented. It is therefore possible to control the voltage to be applied to transfer belt 31 and it is hence possible to achieve stable secondary transfer without any fear of the voltage charged on the transfer belt 31 increasing cumulatively.

According to the color image forming apparatus 1 of the thus configured embodiment, since the intermediate transfer belt 31 can be made to attenuate the potential charged thereon by 1,000 V or greater while it moves from a position where secondary transfer is performed to a position where the initial primary transfer is performed, it is possible to achieve stable primary and secondary transfer operations even when continuous printing is implemented.

Also, according to the present embodiment, since the transfer belt 31 is mainly formed of polycarbonate (PC), polyimide (PI) or thermoplastic elastomer alloy (TPE) having a small time constant ($\epsilon\rho$), it is possible to efficiently attenuate the potential or electric field created across the transfer belt 31 while it moves from a position where secondary transfer is performed to a position where the initial primary transfer is performed.

Finally, the color image forming apparatus of the present invention should not be limited to the above embodiment. Obviously, various changes in the structure may be made without departing from the spirit and scope of the present invention. For example, the multiple process printing units 20 that constitute the image forming means are horizontally arranged in parallel, but they may be arranged in parallel, approximately vertically or in the top and bottom direction.

Further, the present invention should not be limited to the image forming means, primary transfer means, secondary transfer means and other configurations that constitute a color image forming apparatus, but can be applied to any apparatus that uses an intermediate transfer belt.

What is claimed is:

1. A color image forming apparatus having an intermediate transfer belt comprising:

a plurality of image forming units disposed along the intermediate transfer belt from a first image forming unit to a last image forming unit in the direction of movement of the intermediate transfer belt, each having an image bearing member for supporting a developer image formed with a developer corresponding to each color of color-separated image information;

a primary transfer means including the intermediate transfer belt to which developer images formed on the image bearing members are transferred; and a secondary transfer means for transferring the developer image transferred on the intermediate transfer belt to a printing medium, characterized in that the intermediate transfer belt is formed of a material which causes the intermediate transfer belt to attenuate the potential charged thereon by 1,000 V or greater while it moves from a position where secondary transfer is performed to a position where the initial primary transfer is performed, and wherein the distance along the intermediate transfer belt between the secondary transfer means and the first image forming unit is greater than the distance between the last image forming unit and the secondary transfer means.

2. The color image forming apparatus according to claim 1, wherein the residual potential on the intermediate transfer belt, dropped from the voltage applied at secondary transfer after the intermediate transfer belt has moved from the secondary transfer position to the initial primary transfer position, is lower than the voltage to be applied at primary transfer.

3. The color image forming apparatus according to claim 2, wherein the intermediate transfer belt has a resistivity falling within the range of $1\times10^{8}$ to $1\times10^{13}\Omega\cdot$cm, where $R=\rho\cdot d/S$ R: resistance value (Ω)

d: belt thickness (cm)

S: belt area ($cm^2$)

ρ: resistivity (Ω·cm).

4. The color image forming apparatus according to claim 2, wherein the intermediate transfer belt is mainly formed of polycarbonate (PC), polyimide (PI) or thermoplastic elastomer alloy (TPE).

5. The color image forming apparatus according to claim 3, wherein the intermediate transfer belt is mainly formed of polycarbonate (PC), polyimide (PI) or thermoplastic elastomer alloy (TPE).

6. The color image forming apparatus according to claim 1, wherein the intermediate transfer belt has a resistivity falling within the range of $1\times10^{8}$ to $1\times10^{13}\Omega\cdot$cm, where $R=\rho\cdot d/S$ R: resistance value (Ω)

d: belt thickness (cm)

S: belt area ($cm^2$)

ρ: resistivity (Ω·cm).

7. The color image forming apparatus according to claim 6, wherein the intermediate transfer belt is mainly formed of polycarbonate (PC), polyimide (PI), or thermoplastic elastomer alloy (TPE).

8. The color image forming apparatus according to claim 1, wherein the intermediate transfer belt is mainly formed of polycarbonate (PC), polyimide (PI) or thermoplastic elastomer alloy (TPE).

9. The color image forming apparatus according to claim 1, wherein the distance along the intermediate transfer belt between the secondary transfer means and the first image forming unit is equal to at least half of the circumferential length of the intermediate transfer belt.

10. The color image forming apparatus according to claim 9, wherein the residual potential on the intermediate transfer belt, dropped from the voltage applied at secondary transfer after the intermediate transfer belt has moved from the secondary transfer position to the initial primary transfer position, is lower than the voltage to be applied at primary transfer.

11. The color image forming apparatus according to claim 10, wherein the intermediate transfer belt has a resistivity falling within the range of $1\times10^{8}$ to $1\times10^{13}\Omega\cdot$cm, where $R=\rho\cdot$ R: resistance value (Ω)

d: belt thickness (cm)

S: belt area ($cm^2$)

ρ: resistivity (Ω·cm).

12. The color image forming apparatus according to claim 10, wherein the intermediate transfer belt is mainly formed of polycarbonate (PC), polyimide (PI), or thermoplastic elastomer alloy (TPE).

13. The color image forming apparatus according to claim 9, wherein the intermediate transfer belt has a resistivity falling within the range of $1\times10^{8}$ to $1\times10^{13}\Omega\cdot$cm, where $R=\rho d/S$ R: resistance value (0)

d: belt thickness (cm)

S: belt area ($cm^2$)

ρ: resistivity (Ω·cm).

14. The color image forming apparatus according to claim 9, wherein the intermediate transfer belt is mainly formed of polycarbonate (PC), polyimide (PI), or thermoplastic elastomer alloy (TPE).

* * * * *